United States Patent [19]

Kucera et al.

[11] 4,067,209

[45] Jan. 10, 1978

[54] WARP KNIT UPHOLSTERY FABRICS

[75] Inventors: Frank Joseph Kucera, Ilkley; Thomas Desmond Brown, Keighley, both of England

[73] Assignee: IWS Nominee Company Limited, London, England

[21] Appl. No.: 691,980

[22] Filed: June 2, 1976

[30] Foreign Application Priority Data

June 4, 1975 United Kingdom ..... 24084/75

[51] Int. Cl.[2] ..... D04B 23/00

[52] U.S. Cl. ..... 66/195; 297/DIG. 5; 428/253; 428/254; 428/921

[58] Field of Search ..... 66/169 R, 195, 202, 66/192, 193; 297/DIG. 5; 428/253, 254, 921

[56] References Cited

U.S. PATENT DOCUMENTS

| | | | |
|---|---|---|---|
| 2,239,457 | 4/1941 | Gibbons | 297/DIG. 5 |
| 2,741,108 | 4/1956 | Rogosin | 66/202 X |
| 3,082,121 | 3/1963 | Donaldson et al. | 428/921 X |
| 3,378,760 | 3/1976 | Economy et al. | 428/253 X |
| 3,710,598 | 1/1973 | Wilkens | 66/192 |
| 3,767,452 | 10/1973 | Lauchenauer | 297/DIG. 5 |
| 3,806,959 | 4/1974 | Gross | 66/202 X |
| 3,955,032 | 5/1976 | Mischutin | 428/921 X |

FOREIGN PATENT DOCUMENTS

| | | | |
|---|---|---|---|
| 677,974 | 3/1966 | Belgium | 66/202 |
| 1,348,077 | 11/1963 | France | 66/202 |

OTHER PUBLICATIONS

Darlington, K. D., Knitted Upholstery Fabrics, in Knitting Times, 41(28); pp. 20–25, July 3, 1972.

Reisfeld, A., Warp Knit Fabrics & Products, in Knitting Times, 39(34); pp. 32–43, Aug. 17, 1970.

*Primary Examiner*—Mervin Stein
*Assistant Examiner*—Andrew M. Falik
*Attorney, Agent, or Firm*—Harold L. Stowell

[57] ABSTRACT

An upholstery fabric, suitable for providing the sole body-supporting surface in a seat construction with a lightweight, for example tubular, frame, comprises a rigid, knitted base fabric and, interengaged therewith, a fabric surface formed from textile yarns having flame retardant properties. The fabric is preferably warp knitted and the base fabric has a rigid net structure. A decorative surface yarn is preferably interlaced at every course with the base fabric.

4 Claims, 4 Drawing Figures

FULL SET THREADING-UP ON ALL 3 GUIDE BARS.

BAR NO. 1, 2 AND 4 ARE FULLY THREADED UP.

BAR NO. 3, IS HALF THREADED UP.

WARP KNIT UPHOLSTERY FABRICS

This invention relates to upholstery fabrics.

It has been proposed to construct cheap lightweight seats, for example for railway carriages, from light tubular frames carrying open-mesh warp knit fabrics, but having no other springing or padding. In order that the fabrics should be strong enough to withstand the stresses imposed during use, they have been made from high-strength polyester or rayon yarns. Unfortunately, such yarns cannot be dyed satisfactorily without being seriously weakened and, further, they are subject to fire damage from, for example, cigarette ends.

The appearance of such seating is very utilitarian, which is exacerbated by the difficulty in producing fabric of the necessary strength in colours other than white.

The invention seeks to provide a fabric which combines the necessary strength with a markedly improved appearance and improved resistance to heat or fire.

According to the present invention there is provided a compound fabric which comprises a rigid knitted base fabric and interengaged therewith a fabric surface formed from textile yarns having flame-retardant and preferably decorative properties.

The base fabric, from which the compound fabric derives its strength and rigidity, is made up from high strength yarns such as polyester or rayon. Fibres available for automobile tyre reinforcement are particularly suitable. It will be understood that by a rigid fabric is here meant a fabric which is resistant to dimensional changes or distortion in its own plane when under heavy load. A rigid net structure is particularly suitable.

The surface of the fabric may be made from any desired textile fibres having in themselves or by appropriate treatment the necessary flame-retardance. It preferably includes fibres which are of softer handle and more readily colourable than those of the base fabric. Keratinous fibres, especially wool fibres, are particularly preferred for their combination of desirable aesthetic properties and high natural resistance to flame or burning. When wool is used for the surface, its flame resistance may be enhanced by one of our flame-retardant processes described in British Pat. Nos. 1,372,694 or 1,379,752 or Belgian Pat. No. 814,962 or British Patent Application No. 47436/74, which describe the application of titanium, zirconium and tungsten to wool in the form of anionic complexes under acid conditions.

In the construction of the preferred fabrics of the invention, warp knitting is used. Pillar stitches of high-strength yarn are knitted, with more high-strength yarn inlaid to bind the fabric in the weft direction, resulting in a rigid net structure.

The fabric surface is preferably interlaced with the base fabric at every course. It is possible to secure the surface to the base by less frequent interlacing, for example at every second, third or even fourth course, but this although cheaper is less satisfactory because the resulting freedom of movement between adjacent portions of, the two fabric structures leads to abrasion damage in the surface.

The preferred method of producing the surface is to feed relatively heavy count (e.g. carpet yarns) wool yarns by means of fall plate inlaying on a Raschel machine. The combination of pillar stitches and inlaid yarns gives the base fabric the dimensional stability necessary, whereas the fall plate ensures that the surface yarns form a distinct structure covering the surface of the compound fabric. As the surface yarns are not truly knitted but laid into the base fabric, it is possible to use heavier yarns than normal or to use, e.g. woollen yarns or fancy yarns.

Not only may the natural flame-retardant properties of wool surface yarns be improved by a flame-retardant treatment, but the flame-resistance of the compound fabric is preferably further enhanced by applying to the back of the fabric a coating of a flame-resistant polymeric composition. This covers the base fabric yarns and therefore increases the resistance to burning of the fabric as a whole. Furthermore, such a treatment helps to consolidate the fabric, reducing its stretchability, and increasing its tear strength.

The fabric of the invention is suitable for use as the sole body-support fabric on seating and the like. The fabric is secured to a suitable framework, for example of tubular steel or aluminium and requires no springing or padding.

Accordingly, the invention also provides a seat or other support for the human body comprising a framework having body-supporting areas formed by the fabric of the invention.

As mentioned, such seats may be used in railway carriages but their use is not so restricted. Their light weight, relative to convention sprung or padded seating, makes them eminently suitable for all forms of transport, such as road vehicles and aeroplanes. Having regard to the decorative possibilities of the surface structure such seats and the like will also be suitable as domestic furniture.

The following Examples will serve to illustrate the invention, reference being had to the accompanying drawings wherein:

EXAMPLE 1

Figure 1:
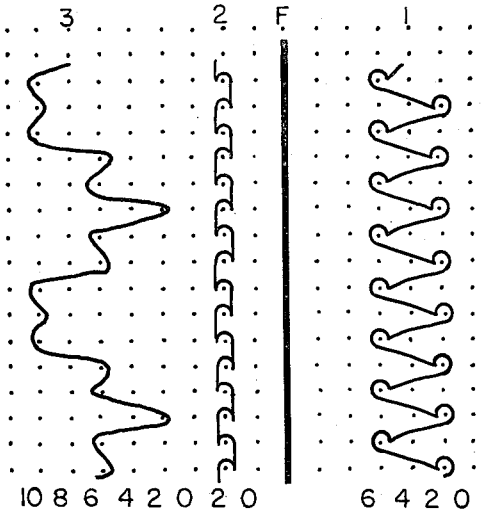
FIG. 1 is a point pattern of a fabric according to the invention.
Figure 3:
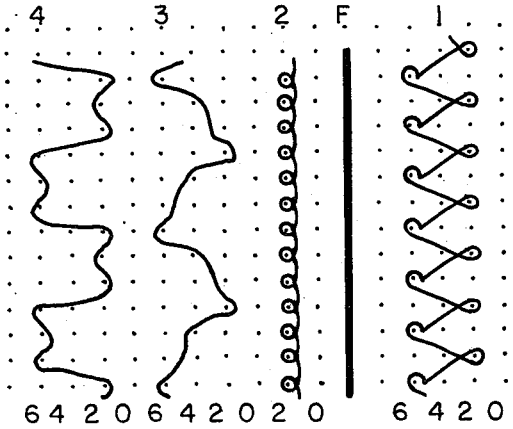
FIG. 3 is a lapping formula for the fabric point patterned in FIG. 1.

A fabric was knitted according to the point pattern shown in FIG. 1 and the lapping formula of FIG. 3 on a 12 gauge Raschel warp knitting machine. The fall plate is indicated in the Figure at F.

Guide bar 1 (front) which was threaded up with a full set carried the surface effect yarns which were 2/70 tex 100% New Zealand Crossbred Wool yarns, which were dyed orange and brown and were treated with Zr for flame resistance according to the process described in our British Pat. No. 1,379,752.

Guide bars 2 and 3, also threaded up with a full set carried 1/830 *d* tex — *f* 144 — S — 116 — 85 Polyester (ICI) yarns.

The fabric as knitted had 8 wales per inch and 15 courses per inch and from its surface appeared to be an all wool fabric with an orange and brown zig-zag design. The weight of the fabric was 1300 g/m$^2$ off the machine. After stentering and applying 164 g/m$^2$ of 'Revertex' DT 5149/2 flame-retardant rubberised latex, the fabric had a weight of 1220 g/m$^2$ and a width of 56 inches.

The fabric was tested and was found to meet British Standard BS 3120 1959 for flame-resistance. When mounted on a seat frame it showed outstanding resistance to deformation on repeated applications of a heavy load.

EXAMPLE 2

Figure 2:
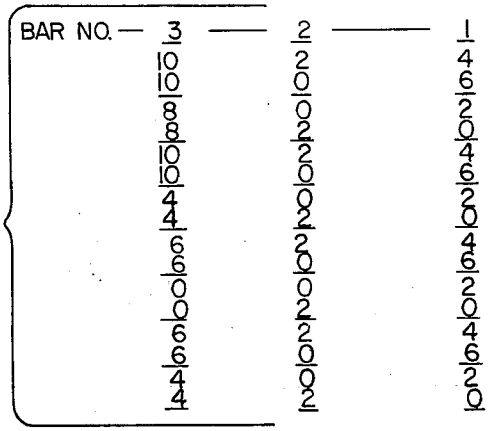
FIG. 2 is a point pattern of another fabric of the invention.
Figure 4:
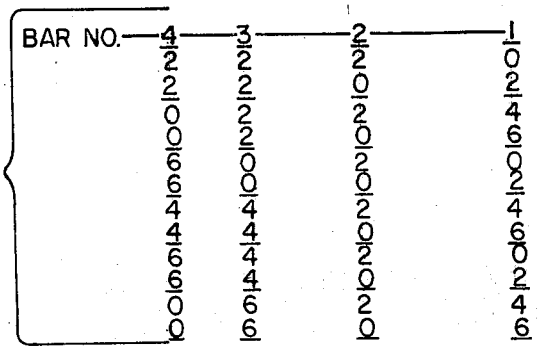
FIG. 4 is a lapping formula for the fabric point patterned in FIG. 2.

A similar fabric to that of Example 1 was knitted according to the point pattern of FIG. 2 and the lapping formulas of FIG. 4. This fabric had an extra inlay of polyester yarn on guide bar 4, which was threaded up with only a half set, to give it even greater dimensional stability.

This fabric also met BS 3120.

We claim:

1. A compound upholstery fabric knitted on a warp knitting machine formed from at least 3 guide bars and including fall plate and ground yarns, suitable for providing the sole body-supporting surface in a seat construction with an open frame, said fabric comprising:

a rigid warp knit net structure comprising pillar and laid-in stitches of high tensile ground yarns constituting a base fabric having dimensional stability in the warp and weft directions;

and a knitted fabric surface comprising the fall plate yarns of a softer handle than the ground yarns, the yarns of said fabric surface being regularly interlaced with said rigid net structure to maintain said fabric surface in interengagement with said base fabric.

2. A compound fabric according to claim 1 wherein the fabric surface is interengaged with the base fabric at every course.

3. A compound fabric according to claim 1 wherein the base fabric is formed of polyester or high tensile rayon fibres.

4. A compound fabric according to claim 1 wherein the fabric surface comprises wool fibres having flame retardant properties.

* * * * *